United States Patent [19]

Kislovski

[11] Patent Number: 4,853,611

[45] Date of Patent: Aug. 1, 1989

[54] INDUCTIVE, ELECTRICALLY-CONTROLLABLE COMPONENT

[75] Inventor: Andre Kislovski, Bern, Switzerland

[73] Assignee: Hasler AG, Bern, Switzerland

[21] Appl. No.: 53,367

[22] PCT Filed: Aug. 15, 1986

[86] PCT No.: PCT/CH86/00119

§ 371 Date: Jun. 29, 1987

§ 102(e) Date: Jun. 29, 1987

[87] PCT Pub. No.: WO87/01505

PCT Pub. Date: Mar. 12, 1987

[30] Foreign Application Priority Data

Sep. 2, 1985 [CH] Switzerland ..... 3771/85
Nov. 13, 1985 [CH] Switzerland ..... 4868/85

[51] Int. Cl.[4] ..... H01F 29/14

[52] U.S. Cl. ..... 323/335; 323/328; 323/338; 323/247; 323/253; 363/75

[58] Field of Search ..... 323/247, 250, 251, 253, 323/307, 328, 332, 335, 338, 355; 363/75, 82, 90, 91, 93

[56] References Cited

U.S. PATENT DOCUMENTS 2,586,657 2/1952 Holt, Jr. ..... 323/335
2,773,134 12/1956 Dunnet ..... 323/335
2,782,269 2/1957 Grant ..... 323/335
2,802,186 8/1957 Dewitz ..... 323/335

*Primary Examiner*—Peter S. Wong
*Attorney, Agent, or Firm*—Horst M. Kasper

[57] ABSTRACT

An inductive component for universal use in any electrical/electronic circuits, whose coefficient of self-induction (L) is independent of the signal, is constant, electrically controllable and can be varied significantly. The component (10) comprises two mutually independent, identical ring-shaped and self-contained ferromagnetic cores (11, 12) which individually carry the partial windings (15.1, 15.2) of an induction winding (15) and jointly carry a control winding (17). The direction of coiling of the windings (15.1, 15.2, 17) is such that the magnetic fields produced by currents through the windings are mutually weakened, but in the other core (12) they are reinforced. The component (10) is connected via its induction winding (15) to a controlled circuit (25), and via its control winding (17) to a controlling circuit (27), or forms with its windings (15, 17) an element of this circuit (25, 27). By varying the current (I) via the control winding (17) the controlling circuit (27) controls the value of the coefficient of self-induction (L) for the controlled circuit (25), a variation range of at least 1:100 being provided.

20 Claims, 4 Drawing Sheets

INDUCTIVE, ELECTRICALLY-CONTROLLABLE COMPONENT

BACKGROUND OF THE INVENTION

The present invention relates to an inductive component. Furthermore, it relates to a process for the operation and the use of the component.

Inductive components are generally known as chokes, as inductive resistors, as signal transmitters, etc. Furthermore, their use in the context of electrical and electronic circuits is known. Their counterparts, as components of such circuits, are resistor and capacitor.

The decisive parameter of an inductive component with respect to a user signal is the relative permeability $\mu_r$ of its core material which, together with the square root of the winding number n of the winding, is proportional to the inductivity L of the component. The inductivity L, in turn, is the value of practical importance which is of interest to a technician in the circuitry and switching field.

Various possibilities exist with regard to the resistor and capacitor components that allow to change the coordinated values of resistance or, respectively, capacity, in a switching circuit in a linear and controllable way by electrical means. Examples of the electrically controllable resistor are the electronic tube, in particular the pentode, or the field effect transistor. An example of the electrically changeable capacitor is the semiconductor diode in a backward voltage connection.

The known electrically controllable inductive components such as variometer, magnetic amplifier, regulating inductor, etc., cannot be compared with the field effect transistor or semiconductor diode recited in the examples. These components operate essentially by exploiting non-linear magnetization curves, where the alternating currents to be controlled during each wave period pass through a substantial part of the magnetization curve and these currents drive the magnetic core for a longer or shorter time into saturation. This process is associated with a dramatic change of the wave shape in each case. Therefore, the recited inductive components can be compared more closely with the present-day phase control circuits such as, for example, those using thyristors.

SUMMARY OF THE INVENTION

It is the object of the invention to provide, as a counterpart to the electrically controllable resistors and capacitors, an inductive component for universal use in any electrical/electronic circuits, whose coefficient of self-induction L is independent of the signal, is constant, and can nevertheless be varied in wide ranges.

The solution of this object is given by the characterizing portions of the independent claims. This means, in short: There is provided an inductive component with a constant relative permeability $\mu_r$ as a user signal, whose value is variable over a range of at least 1:100.

This latter characterization sounds like the solution of a universal desire, which is in fact the case. The novel inductive component combines for its inductivity for the first time the five properties, independent of the signal, linear or, respectively, constant, electrically controllable, galvanically separated, and with a wide range of variability. These properties substantially distinguish the present inductive component from all known inductive elements.

The inductive component, according to the solution given of the invention object and the applications indicated, open the path to a multitude of different novel circuits, for which there has certainly existed a substantial need for a long time, but which circuits could hardly be realized up until now. The novel inductive component and its use in accordance to the invention are therefore suitable to provide new possibilities and thus a substantial boost to the electrical/electronic circuit technique.

BRIEF DESCRIPTION OF THE DRAWINGS

The invention is further described by means of the 13 exemplified figures that follow, where various references to the state of the art are given and the respective differences are stated. They show.

DETAILED DESCRIPTION OF THE PREFERRED EMBODIMENT

Figure 1:
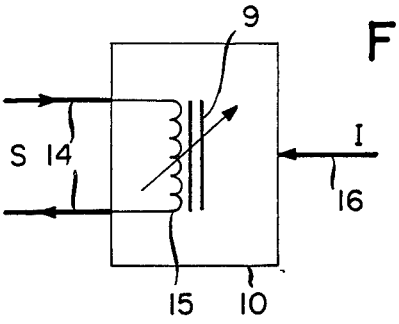
FIG. 1—General schematic view of a controllable inductive component

FIG. 1 illustrates purely schematically and in general an inductive component 10, which can be controlled electrically via its control input 16. The component 10 comprises a ferromagnetic core 9 and an induction winding 15. The component 10 exhibits an inductivity L toward the outside, i.e. versus its two signal connections 14, which inductivity L is independent of the shape, amplitude, and frequency of the user signal S. which user signal is applied at the signal connections 14. The inductivity L is thus a real constant whose value is however variable over wide ranges via an electrical control signal that is applied to the signal input 16, i.e. in particular via a control current I. The variability, the adjustability or, respectively, the controllability of the inductive component 10 is indicated in FIG. 1 with an arrow, which crosses the core 9 and the induction winding 15.

The inductive component 10 illustrated forms a true, electrically controllable component for the construction of any electrical and/or electronic circuits, whose counterparts are electrically controllable resistors and electrically controllable capacitors. The inductivity L of the component 10 is thus to be understood analogous to the resistance value R of a component "controllable resistor" and to the capacity C of a component "controllable capacitor." Just as these values R and C are independent of the signal, the value L of the component 10—and let us repeat this—is independent of the signal.

Figure 2:
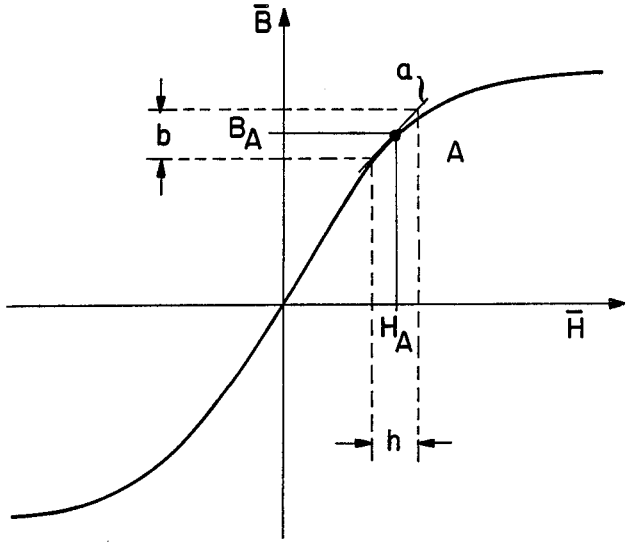
FIG. 2—Dependence of the magnetic flux density $\overline{B}$ on the magnetic field strength $\overline{H}$ for a ferromagnetic core FIG. 3—same dependence for two identical cores FIG. 4—same dependence for two pairs of cores having differing cores FIGS. 5*a* & 5*b*—Schematic construction of an electrically controllable inductive component according to the invention FIG. 6—Practical construction of the inductive component according to FIG. 5

Reference is made to FIG. 2 with regard to an explanation of the construction and the mode of operation of the inductive component 10 according to the invention.

FIG. 2 illustrates the dependence of the magnetic flux density $\overline{B}$ on the magnetic field strength $\overline{H}$ for a core 9 made of a suitable ferromagnetic material, in particular, of a ferrite. This dependence is well known as a magnetization curve or a hysteresis curve. The curve illustrated in FIG. 2 refers in particular to the curve of a soft magnetic material, where the two arms of the hysteresis coincide substantially, that is, they are substantially identical for increasing and decreasing field strength $\overline{H}$.

The total magnetic field strength $\overline{H}$ is laid down on the abscissa, which total magnetic field strength is composed of a pre-magnetization field strength H and a signal field strength h, and the total magnetic flux density $\overline{B}$ <is plotted> on the ordinate, which is composed of the pre-magnetization flux density B and the signal flux density b.

Any point of operation A can be set at the core 9 by way of a control current I, via a control winding, not mentioned as yet, influencing the core 9. This means that the core is pre-magnetized such that $\overline{H}=H_A$ and $\overline{B}=B_A$. In this state a user signal S, which interacts with the core 9 via the induction winding 15, effects at the operation point A a superposed signal field strength h and a signal flux density b coupled to it. The relative permeability $\mu_A=b/\mu_o \cdot h$ (where $\mu_o$ is the magnetic field constant or, respectively, the permeability of the free space), provided in each case by the ratio of these two values b and h, corresponds to the slope a of the magnetization curve at the recited operation point A for very small signals S. In contrast, for larger signals S, $\mu_A$ is in general not constant, whereby substantial signal distortions are generated.

The subject-matter described thus far to be considered in connection with FIG. 2 is known, for example, from the reference H. Krakowski, "The Magnetic Control Technique and its Applications in the Power Supply Plants of the Postal Service of the Federal Republic of Germany," Der Fernmelde-Ingenieur, Volume 8, Issue 7, pages 1ff (July 15, 1954), in particular from the section "Control of Inductivity" (pages 5 and 6).

The connection between b and h can be represented mathematically in the shape of a Taylor series for each operation point A of the magnetization curve. This sequence reads $$b=a_1 \cdot h+a_2 \cdot h^2+a_3 \cdot h^3+a_4 \cdot h^4+\ldots$$

with terms for each exponent of h. The terms of larger exponents are to be neglected for very small values of h. For larger values of h, in contrast, all terms are of importance, which means there is a substantial non-linearity between b and h and is the mathematical expression for the recited non-constancy of the relative permeability $\mu_A$ in each case.

If signal distortions caused by the described non-linearity are to be avoided, then the point of operation A should be selected in a linear region of the magnetization curve. A first such region with maximum permeability $\mu$ is present for most core materials in the case where $\overline{H}=H_A=O$ and $\overline{B}=B_A=O$, that is, in the region around the zero point of the magnetization curve or, respectively, in the region of the absence of a pre-magnetization. This is therefore the region which is markedly preferred in conventional technology and in which most of the work is done.

A second non-linear region of the magnetization curve is present at large values of $\overline{H}$, which is known as saturation. In this region the relative permeability $\mu_A$ is very small, that is, its value becomes approximately 1 and corresponds thus only to the value of non-magnetic or low-magnetic materials. Therefore, the saturation region is considered uninteresting from a conventional point and remains unconsidered with the exception of a few special cases. In the special cases, the saturation region serves for example for the release of trigger signals which indicate the reaching of saturation. An example for this use can be found in the reference U.S. Pat. No. 3,541,428 (F. C. Schwarz, Unsaturating saturable core transformer).

Figure 3:
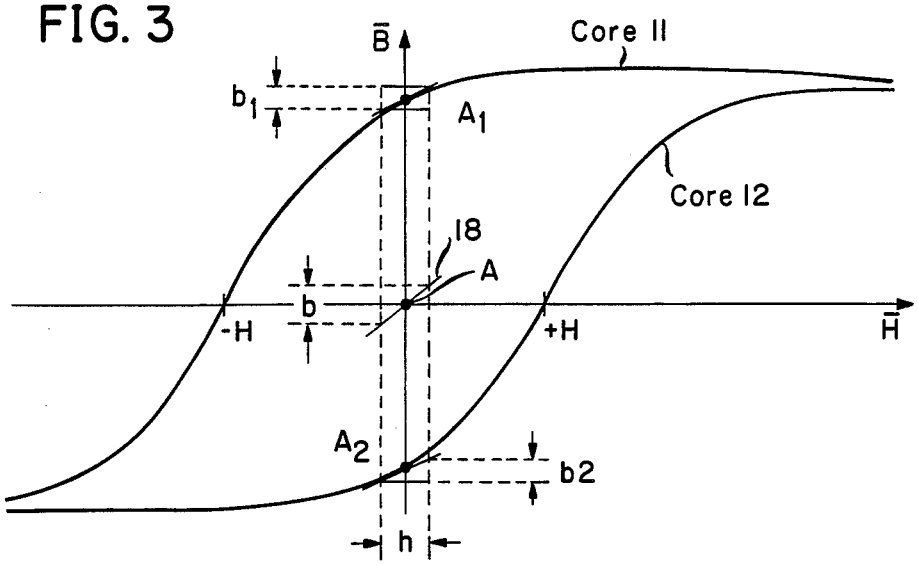

According to these considerations, which essentially represent the state of the art, it is shown in the following how the problem of the non-linearity between the magnetic signal flux density b and the corresponding magnetic signal field strength h can be overcome. For this purpose, the core 9 is split initially into two equal cores 11 and 12, each having half of the cross-section of the core 9. Furthermore, each of these partial cores is provided with an induction winding, both of which exhibit half the number of turns of the induction winding 15 of the device 10 described up to now. The cores 11 and 12 thus have identical properties but they are operated in a different way. This is shown in FIG. 3. By comparison to FIG. 2, the total field strength $\overline{H}$ of the core 11 and that of the core 12 is plotted on the abscissa and, correspondingly, the total flux density $\overline{B}$ is plotted on the ordinate. The course of the two magnetization curves of the cores 11 and 12 is identical to that of the core 9 of FIG. 2, due to the identical core material and the identical core geometry.

An operation point $A_1$ is set in the core 11 by a first control current $I_1$ in analogy to FIG. 2, which operation point corresponds to a magnetic field strength $\overline{H}=H_{A1}$ and to a magnetic flux density $\overline{B}=B_{A1}$. According to the representation, the ordinate is placed through this operating point $A_1$, which means displacing the abscissa by the amount $H_{A1}$ to the left. This is allowable and has no physical consequences.

An operating point $A_2$ is also set in the second core 12 by a second control current $I_2$ which operating point $A_2$, however, in contrast to the operating point $A_1$ of the core 11, is not disposed in the first quadrant, but in the third quadrant of the representation. Furthermore, the respective abscissa is displaced toward the right by the amount $H_{A2}$ of the respective corresponding pre-magnetization field strength such that the two operating points $A_1$ and $A_2$ are at the same ordinate. Finally care is taken that the value of $H_{A1}$ is equivalent to that of $H_{A2}$.

For the relationship between the signal flux density $b_1$ given by the core 11 and the signal field strength h of a signal S effective at the operating point $A_1$, the same series representation holds true as in FIG. 2

$$b_1=a_1 \cdot h+a_2 \cdot h^2+a_3 \cdot h^3+a_4 \cdot h^4+\ldots$$

Correspondingly it holds for the core 12 under consideration of the symmetry of the magnetization curve and of the position of the operating point $A_2$ in the third quadrant for the same signal S $$-b_2=a_1(-h)+a_2(-h)^2+a_3(-h)^3+a_4(-h)^4+\ldots$$

If the signal S is effective simultaneously and in the same way on the two cores 11 and 12 with the symmetrically adjusted operating points $A_1$ and $A_2$, then the combined signal flux density b effective in this case is $$b=b_1+(-b_2)=2a_1\cdot h+2a_3\cdot h^3+\ldots$$

This expression shows that, through the combination of the cores 11 and 12 for each symmetrical pair of operating points $A_1$, $A_2$, a very substantial linearization of the relationship of b and h is achieved, since all members with even-numbered powers of h cancel each other. Thus, for signals that are not too large, the first member of the series becomes dominant in such a way that one can speak of a quasilinear relationship between b and h, that is independent of the operating points $A_1$, $A_2$ selected in each case in pairs.

The factor $2a_1$ of the first remaining member corresponds to the slope of the two magnetization curves in the operating points $A_1$ and $A_2$. Because of the halving of the induction windings 15 of the partial cores 11 and 12, for an unchanged signal S in FIG. 3, compared to FIG. 2, it would have been more appropriate and correct to write $<\frac{1}{2}h>$ instead of "h", the factors $\frac{1}{2}$ and 2 balance each other mutually. For the premagnetization field strength $H=-H=O$, the operating points $A_1$ and $A_2$ coincide and a state exists as with an individual non-split core 9.

The quasilinear relationship between b and h at the total operating point A is entered in FIG. 3 with the reference numeral 18. Each arbitrary user signal S (for example a rectangular signal of 1.7 $V_{ss}$, a scanning ratio of 5 to 2, and a frequency of 37.6 kHz) influences the illustrated component 10 only in this operating point A. The self-induction L effective in this case is proportional to the respective permeability $\mu_A$, given by b and h, i.e. proportional to the slope $2a_1$ of the line 18 of b and h.

The magnetization curves of the two cores 11, 12 displace themselves in opposite direction along the abscissa H, due to a symmetrical change of the pre-magnetization of the cores 11 and 12 by changing of the opposite premagnetization field strengths H or, respectively, −H. Thereby, the operating points $A_1$ and $A_2$ slide on the ordinate, in the opposite direction of one another, either upward or downward, respectively. Therefore, in general, a changed slope $2a_1$ is set at the total operating point A in each case, which slope represents for the given user signal S a correspondingly changed self-induction value L.

The slope of the magnetization curve varies substantially from the zero point to the deep saturation in case of the usual ferromagnetic core material. Correspondingly, the self-induction value L can be varied in each case in a ratio of at least 1:100 based on the illustrated symmetrical setting of the operating point $A_1$, $A_2$. In case of certain core materials, a ratio of 1:1000 is obtainable without difficulty.

The component 10 with two cores 11 and 12, which are premagnetized at the same intensity in opposite direction, thus represents a linear (or, respectively, constant) electrically controllable self-induction L, as was described at the start of the disclosure as corresponding to the electrically controlled resistance R and the electrically controlled capacitance C. In this case, the control is performed via the control currents $I_1$ and $I_2$ and the premagnetization +H or, respectively, −H connected therewith of the cores 11, 12.

The region in which the self-induction L can be considered a constant value is determined by the above recited Taylor series $b=b_1+b_2$ and its members. The user signals S are to be adapted in their value to this region. This means that the signal field strength h of the user signal S in each case is always smaller versus the variation region in which the premagnetization field values H and −H can be adjusted. Thus, the amplitude of a user signal S has always to be so small that it is far from being sufficient to drive the cores 11 and 12 to saturation. This is also to be expressed by the selection of the small letters h for the signal field strength and b for the signal flux density versus the upper-case letters H and B of the corresponding premagnetization values.

If, as desired, the region 18 for each pair of operating points $A_1$, $A_2$ is to be as long as possible and as linear as possible, then there arises the requirement that the magnetization curve of the core material to be employed is curved as uniformly as possible over its full region and that there is no saturation bend over its full region. Expressed by way of the Taylor series $$b=a_1\cdot h+a_2\cdot h^2+\ldots$$

this means that, at each operating point $A_1$ or, respectively, $A_2$, the factor $a_1$ of the first member should be as big as possible and the factors $a_2$, $a_3$, $a_4$ . . . of the other members should be relatively as small as possible. Expressed by way of the first derivative $d\overline{B}/d\overline{H}=f(\overline{H})$, this means that the derivative is to exhibit as few as possible pronounced inflection points. A well-suited material which, in addition, is also suitable for high frequency, is, for example, the material "H" of the company Magnetics which exhibits, in case of a toroidal core $22.1\times13.71\times6.35$, an $A_L$-value of approximately $18{,}000\cdot10^{-9}$ H/w$^2$.

For further embodiments of the invention, the following basic variants can be cited:

(a) Variants relating to the cores 11 and 12:

(aa) By maintaining the exhibited symmetry of the cores (11, 12) independent of each other, each core can be composed of two or more partial cores where the total cross-sections of all partial cores have to be equal in pairs. The combination of the partial cores can be performed concentrically or axially.

(ab) As a preferred and practically important embodiment, two or more pairs of cores 11, 12 can be employed that exhibit differing core materials. In this way, a superpositioning of different magnetization curves is generated which is, however, overall symmetrical for the control currents $I_1$ and $I_2$ and for the resulting operating points $A_1$ and $A_2$. This is illustrated in greater detail in FIG. 4.

(b) Variants relating to the control:

(ba) The opposite premagnetization of the cores 11 and 12 can be achieved by opposite direction of the control current $I_1$ and $I_2$ or by opposite sense of winding of the control windings.

(bb) The premagnetization of the cores 11 and 12 can be achieved by individual current $I_1$, $I_2$ or by superpositioning of the effect of different control currents $I_n$ which, for example, flow through different control windings, that is, by $I_1=\Sigma i_{n1}$ and $I_2=\Sigma i_{n2}$.

Figure 4:
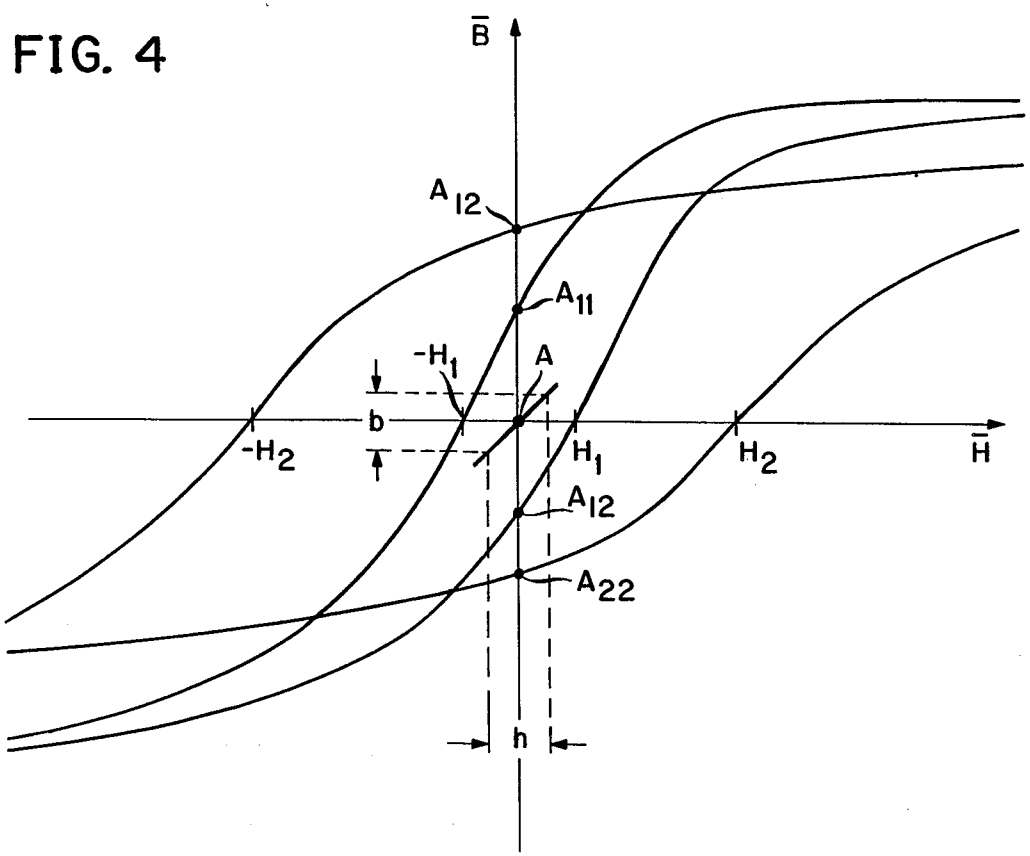

(bc) In the case of two or more pairs of partial cores, the premagnetization of each pair of partial cores can be performed independently of the premagnetization of each respective other pair of partial cores. This is illustrated in FIG. 4 which corresponds substantially to the representation of FIG. 3. In contrast to this representation, however, two pairs of differing magnetization curves are illustrated which correspond to cores of differing core material according to the variation (ab) and which cores are in addition premagnetized in different ways. In this way, altogether four partial operating points $A_{11}$, $A_{12}$, and $A_{21}$, $A_{22}$ are generated which are joined, symmetrically and in pairs, to form the overall operating point A. The slope $2a_1$ of the linear region 18 can be varied by changing the premagnetization of each of the core pairs individually.

(c) With reference to the user signal S:

By introduction of several induction windings 15, it is possible to allow the relative permeability $\mu_a$, adjusted in each case, to act on several user signals S. This means that, with the same number of turns of the induction windings, the same self-induction L is obtained and, with a different number of turns of the windings 15, however, correspondingly different values of the self-induction L, as well as a coupling of the signals S, are obtained.

Figure 5:
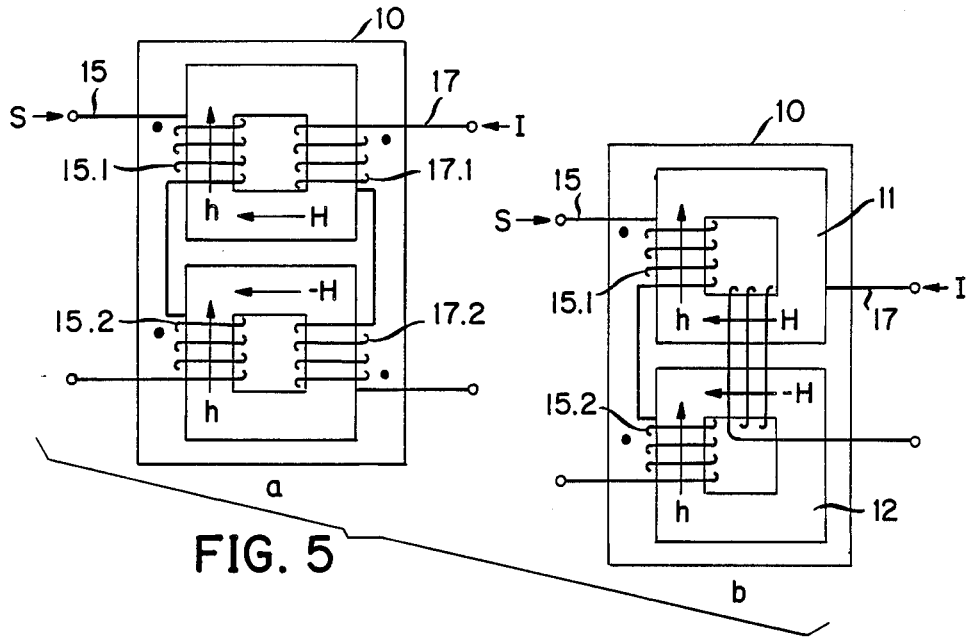

Whereas the electrically controllable inductive component 10 has been described above in detail with respect to its properties and its variations, FIG. 5 illustrates schematically two possibilities for the very simple physical construction, which construction may indeed be known as an illustration as, for example, from the already cited reference U.S. Pat. No. 3,541,428 or from U.S. Pat. No. 2,802,186 (G. H. Dewitz, Saturable core apparatus), however, its particular functioning is novel.

According to FIG. 5, the component 10 comprises in each case two magnetically independent cores 11 and 12 which cores are identical with respect to their geometry and their core material, which cores have ferromagnetic properties and which cores form rings closed in themselves. Furthermore, the component 10 includes an induction winding 15, which is composed of two partial windings 15.1 and 15.2, which are connected in series, exhibit the same number of turns, and which partial windings each individually wind around one of the cores 11, 12 in the same sense of winding. Finally, the component 10 comprises, according to FIG. 5*a*, a control winding 17 which, again, is composed of two partial windings 17.1 and 17.2, which are connected in series and which exhibit the same number of turns and which, again, each individually wind around one of the cores 11 and 12, where, however, the one partial winding 17.1 runs in a first sense of winding and, the other partial winding 17.2 runs in an opposite sense of winding. According to FIG. 5*b*, the component 10 comprises a single control winding 17 which winds around the two cores 11, 12 as one.

According to the two construction variants of FIG. 5, the control currents $I_1$ and $I_2$ become necessarily equal for the premagnetization of the cores 11 and 12 so that the premagnetization field strengths H or, respectively, −H are also equal according to their values. The direction of the premagnetization fields is of the opposite sense in the two cores 11 and 12 (as indicated by the arrows H or, respectively, −H) which expresses the presence of the minus sign (−) of the field strength H in the core 12. The signal field strengths h are generated by a user signal S via the induction winding 15 and are superposed in the cores 11 and 12 on the pre-magnetization fields H or, respectively, −H, and are also of equal value and show the same sense of rotation, which is indicated by the arrows h. Thus, respectively, the field h intensifies the pre-magnetization field H in the core 11, while the field h weakens the pre-magnetization field −H in the core 12. This is just the behavior as it was illustrated in FIG. 3 for a component 10 with two cores. Thus, an element according to FIGS. 5*a* or 5*b* represents a first, and in fact a very simple, realization of the component 10 illustrated above.

Figure 6:
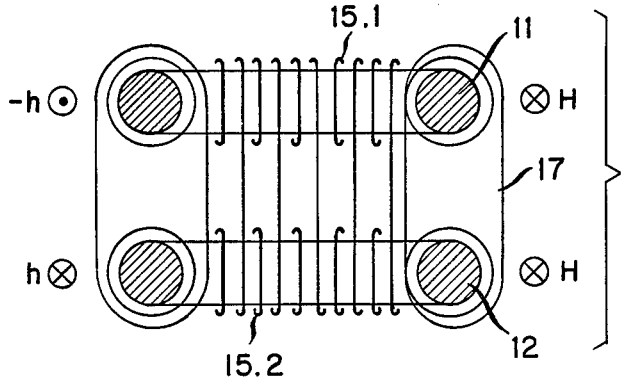

For practical purposes, a somewhat modified construction of the component 10 according to FIG. 5*b* is preferred, as it is shown in FIG. 6 in a sectional view. Accordingly, the ferromagnetic cores 11, 12 are two identical, coaxially disposed, cylindrical or preferably toroidal ring cores (in particular ferrite cores), of which each is wound substantially over its full angle region uniformly with a partial winding 15.1 or, respectively, 15.2, with an equal number of turns. These partial windings have an opposite sense of winding. In a second working step, the control winding 17 is wound jointly over the coaxially joined cores 11 and 12 and their partial windings 15.1, 15.2, as well as uniformly over the full angle region, whereby, as a side effect, it mechanically holds together the cores 11 and 12. According to this construction, the premagnetization fields H and −H have the same sense of rotation, whereas the signal fields h have an opposite sense of rotation in the two cores 11 and 12. This is indicated by the symbols ⊗ and ⊙ next to the sectional area of the cores 11, 12.

The preference of toroidal cores 11, 12 results not only in a very compact construction assembled out of commercially available parts, but it also results in optimum electrical properties, since the field H is uniformly distributed in a torus and, therefore, only minimum magnetic leakages occur. The coupling of the windings 15 and 17 with the cores 11, 12 is furthermore at a maximum, whereas the coupling between the cores 11 and 12 among each other is again at a minimum. Such a component 10 constructed of toroidal cores 11, 12 is thus associated with properties in addition to those illustrated in FIG. 3 that make it useful to be employed at high frequencies of up to at least 100 kHz. This means in particular that damaging interactions between the windings 15 and 17 and/or damaging capacities in the windings 15 and 17 hardly occur. The windings 15 and 17 are, with respect to their function, in principle mutually exchangeable. Because of the described high frequency properties, it is however advantageous if the winding 15—as described up to now—is employed as a signal winding, and the winding 17 is employed as a control winding.

The size and the shape of the core 11, 12, the core material, the number of turns, the thickness of the wire, and the winding range of the windings 15 an 17 are to be selected according to purely practical requirements which result from the type of application of the respective component 10. They are irrelevant for the principal mode of operation of the component 10. In particular, the cores 11, 12 can be formed, in principle, also slotted or even rodlike instead of toroidally closed (in particular as toroidal ferrite cores). This, however, results in such a considerable deterioration of all properties because of the then unavoidable magnetic stray fluxes, that such a construction of a component 10 could hardly be considered sensible.

A symbolic representation is selected in order to give an overview explanation of the technical constructions of the variants of the component 10 illustrated under points (a) and (c).

Figure 7:
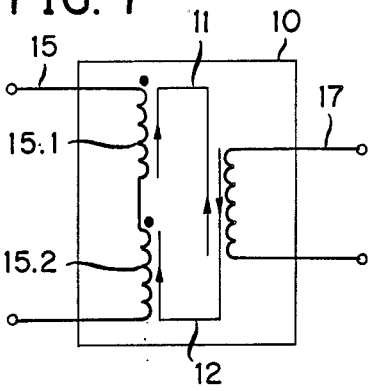
FIGS. 7 to 12—Symbolic representations of variants of the component according to FIGS. 5 and 6

FIG. 7 shows the symbolic representation for a component 10 corresponding to FIG. 5*b*. This component 10 exhibits the two cores 11 and 12 which are both in interaction with the control winding 17 and, in fact, in an apposite sense caused by the kind of winding illustrated in FIG. 5. This is illustrated by the two inversely directed arrow tips in the cores 11, 12 next to the winding 17. The partial windings 15.1 and 15.2, connected, in series exhibit the same sense of winding, which is represented by a dotted line next to the partial windings and by equidirected arrow tips in the cores 11, 12 next to the partial windings 15.1 and 15.2.

Figure 8:
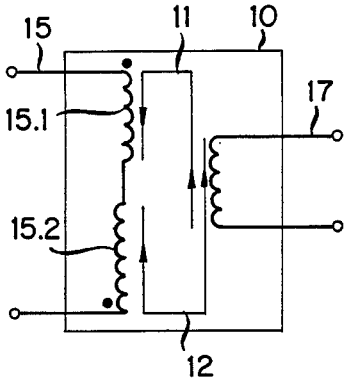

FIG. 8 shows a symbolic representation of a component 10 which corresponds to the component shown in FIG. 6. In this component, the partial windings 15.1 and 15.2 exhibit a different sense of winding, whereas the sense of winding of the control winding 17 is the same for both cores 11, 12.

Figure 9:
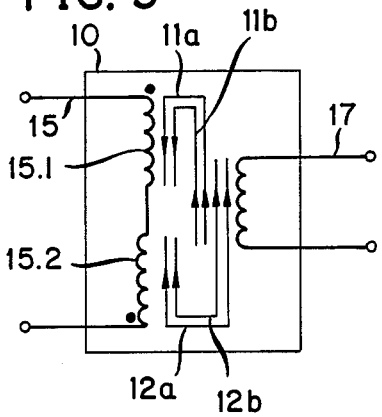

FIG. 9 shows a symbolic representation of a component with two pairs of cores, which are combined in pairs (for example, coaxially or concentrically). The control winding 17 surrounds all four cores 11*a*, 11*b*, 12*a*, 12*b* jointly with a uniform sense of winding. The partial windings 15.1 and 15.2 surround each two cores 11*a*, 11*b* or, respectively, 12*a*, 12*b*, with an inverse sense of winding. This component corresponds to the illustrated variant (aa). If the core material of the cores 11*a*, 11*b* is different from the material of the cores 12*a*, 12*b*, then the component corresponds to the variant (ab).

Figure 10:
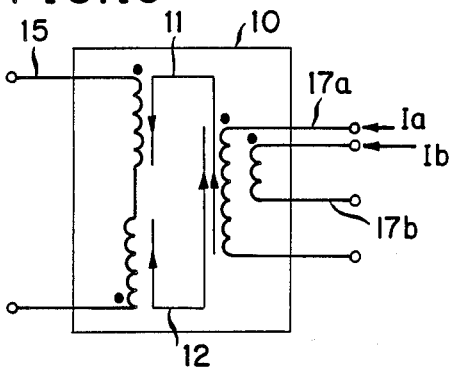

Fig. 10 illustrates a symbolic representation of component 10 corresponding to the variant (bb). This component 10 exhibits two control windings 17*a* and 17*b* which, for example, have the same sense of winding and a differing number of turns. The two control windings 17*a* and 17*b* are galvanically separated and act on the cores 11 and 12. Such a component 10 allows a convenient superpositioning of two control current $I_a$, $I_b$, where a full separation of the potentials is automatically assured.

Figure 11:
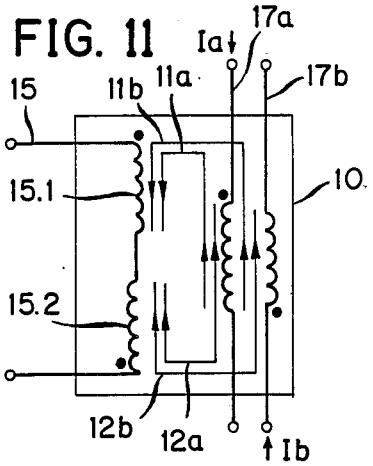

FIG. 11 illustrates a symbolic representation of component 10, corresponding to the variant (bc). This element exhibits two pairs of cores 11*a*, 12*a* and 11*b*, 12*b* of the same or of a different core material. A control winding 17*a* or, respectively, 17*b*, is coordinated to each of the pairs, possibly with differing senses of winding, as illustrated. The partial windings 15.1 wind around the cores 11*a* and 11*b*, and the partial windings 15.2 wind around the cores 12*a* and 12*b*. The core pairs 11*a*, 12*a* and 11*b* and 12*b* can be independently premagnetized by the control currents $I_a$ and $I_b$ either in the same sense (as shown) or also in an opposite sense. Thereby, the interference effects on the control lines can be compensated for and/or a further improved linearization can be achieved of the respective permeability $\mu_A$ effective on the user signal S.

Figure 12:
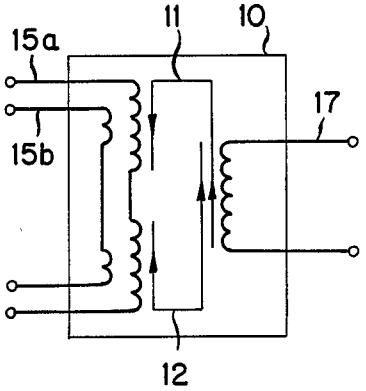

FIG. 12 illustrates the symbolic representation of a component 10, corresponding to the variant (c), with two induction windings 15*a* and 15*b*, which can, for example, be employed as primary and secondary windings of a transformer or pulse transformer and which <reduction windings> can exhibit the same or differing number of turns.

Further variants, not illustrated here in detail, are generated by combinations of the elements according to FIGS. 7 to 12 and/or by expansions with third and fourth windings of the same kind, where overall the symmetry shown in FIGS. 3 and 4 must remain assured.

Figure 13:
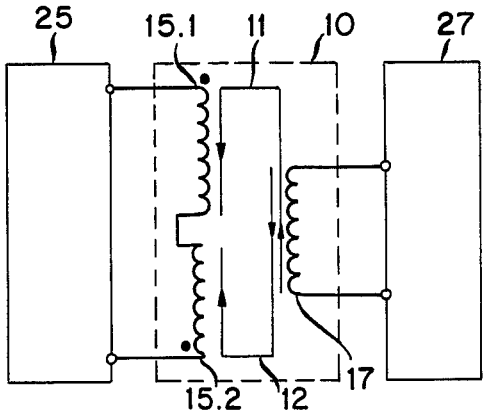
FIG. 13—Schematic representation of a use in accordance with the invention of the component according to the preceding figures.

The component can be employed as general electrically controllable component with a self-induction L, constant at each adjustment, and can be employed wherever an electrically controllable inductivity is appropriate in an electrical and/or electronic circuit. Simple examples of a use according to the invention include, for example, a variable inductive reactance or an oscillating circuit which can be tuned via its inductivity. In the context of such uses, the component 10 according to FIG. 13 is always connected with its induction winding 15 to a controlled switching circuit 25 and is always connected with its control winding 17, to a controlling switching circuit 27 or, respectively, forms with these windings a part of these switching circuits, that is to say, the controlling switching circuit 27 sets a linear inductivity for the controlled circuit 25 with a value which can be situated within a wide range.

In the case of several induction windings 15*a*, 15*b* and/or several control windings 17*a*, 17*b*, these windings can be connected to differing inputs of the same switching circuit 25 or, respectively, 27, or they can be connected to corresponding separate switching circuits.

The inductive component 10 is associated with the substantial advantage versus comparable components of controllable resistances R and controllable capacitors C that its current circuit are galvanically separated by nature. Therefore, different potentials in the current circuits, for example 25 and 27, do not play any role.

The control of the component 10 is performed via arbitrary currents I of a frequency which is not too high. In this connection, of particular importance are the direct current, the sinusoidal current associated with an alternating current grid, and the pulsating unsmoothed direct current obtained by rectification of a sinusoidal current. Thereby, the control can operate statically or dynamically whereby, however, substantial inductive feedbacks of the control winding 17 on the control current I are to be avoided. This is in contrast to the use of user signals S which are preferably of high frequency (frequency larger than about 1 kHz) and where an inductive effect is especially desired.

The component 10 is produced by conventional methods with parts available in the marketplace and is therefore very economical. It is insensitive to destructive influences of any kind. Finally, it can be adapted by the embodiments of the invention as well as by practical steps to various kinds of applications, for example, to applications in the high frequency range, to the data of energy converters, to the functions of the digital and analogue techniques, to the problems of the measurement and control techniques, etc. In the latter case, the component (10) can be very advantageously used as an actuator for influencing the value to be controlled in each case, for example, of an alternating current.

In the context of other applications, the signal conversion is a primary object, for example, by means of an inductive transmitter or a transformer, respectively. In this kind of application, the user signal S is in each case subjected to a variable inductive influence and, in fact, in such a way that the user signal S itself, or a value derived from it, is amplified or attenuated to such a degree as it corresponds to the respective inductive influence.

The following are recited as examples: a potentiometric attenuator for an alternating current signal comprising a series connection of an inductive fixed resistor and a component 10. Or, a transformer with variable, controllable "turns ratio" between primary and secondary winding, where the user signal is fed to the primary winding in a more or less attenuated state, such that the derived value, that is, the voltage at the secondary winding, is correspondingly larger or smaller.

Such switching circuits are described in detail in another application (Swiss Patent Application 3 964/85-7).

Overall it can be said without exaggeration that the component 10 forms a basically novel component with excellent properties, where the application possibilities are so numerous that they can hardly all be enumerated in detail.

I claim:

1. An inductive, electrically controllable device (10) comprising two identical ferromagnetic cores (11, 12) which are independent from each other and co-axially disposed, and each of said cores is annularly closed, a control winding (17) which winds around the two identical ferromagnetic cores (11, 12) jointly, and an induction winding (15) which winds around the two cores (11, 12) individually in a configuration of two partial windings (15.1, 15.2) connected in series, in such a way that magnetic fluxes, created by currents running through the windings (17, 15.1, 15.2) in the cores (11, 12), are uni-directional in one of the cores and inverse-directional in the other one of the cores, characterized in that a functional dependence of the magnetic flux density B on the magnetic field strength H for a soft magnetic core material exhibits a curvature that has a progressively varying incremental permeability over its full region and thus substantially identical in its flux versus field strength curve for increasing and for decreasing field strength (H), and whose slope varies at least over a range defined by a ratio of 1:100 (FIG. 2, 3, 7, 8).

2. Device (10) according to claim 1, characterized in that the core material is suitable for high frequency.

3. Device (10) according to claim 1, characterized in that at least a second pair of cores (**11*b*, 12*b*) is associated with the two first identical ferromagnetic cores (11, 12, respectively, 11*a*, 12*a*), where the core material of said second pair of cores in different from the core material of the first identical ferromagnetic cores (11*a*, 12*a*) in such a way that each partial winding (15.1, 15.2) winds around one core (11*a*, 11*b*; 12*a*, 12*b*) of each pair, and that the control winding (17) winds around all cores (11*a*, 12*a*, 11*b*, 12*b*) jointly (FIGS. 4, 9**).

4. Device (10) according to claim 1, characterized in that at least a second pair of cores (**11*b*, 12*b*) is associated with the two identical ferromagnetic cores forming a first pair of cores (11, 12, respectively, 11*a*, 12*a*), where the core material of said second pair of cores is different from the core material of the first cores (11*a*, 12*a*) in such a way that each partial winding (15.1, 15.2) winds around one core (11*a*, 11*b*; 12*a*, 12*b*) of each pair, and that at least two control windings (17*a*, 17*b* ) are provided of which two control windings each one winds around cores (11*a*, 12*a*, 11*b*, 12*b*) jointly of a respective pair composed of one of the first cores and one of the second cores (FIGS. 4, 11**).

5. Device (10) according to claim 1, characterized in that at least one further control winding (**17*b*) and/or one further induction winding (15*b*) are added to the control winding (17, or respectively, 17*a*) and the induction winding (15, or respectively, 15*a*) and that at least the further control winding (17*b*) and/or the further induction winding (15*b*) are parallel to one another, and jointly wind around the cores (11, 12) (FIG. 10, 12**).

6. Process for the operation of the device according to claim 1, comprising the steps of feeding a control current (I) through the control winding (17), wherein the current intensity of said winding can be set arbitrarily, including zero, and feeding a signal current (S) of arbitrary form and frequency through the induction winding (15), wherein the amplitudes of the signal current correspond to a current intensity that is small compared to the maximum current intensity of the control current (I).

7. Process according to claim 6, further comprising feeding an additional control current (Ib) through at least one second control winding (**17*b*) (FIG. 10, 11**).

8. Process according to claim 6, further comprising feeding an additional signal current (S) through at least one second induction winding (**15*b*) (FIG. 12**).

9. Process according to claim 6, maintaining a timely amplitude variation of the control current I as small compared to the corresponding variation of the signal current S.

10. Process according to claim 9, further comprising limiting the control current I to be a quasi-direct current and limiting the signal current S to be an alternating current having a frequency of at least 1 kHz.

11. Process according to claim 9, further comprising a first alternating current for the control current (I); employing a second alternating current for the signal current (S); maintaining the frequency of the first alternating current to be smaller than the frequency of the second alternating current.

12. Use of a device (10) according to claim 1 comprising the steps passing a signal current through a coil for influencing the coil inductively;

adjusting an intensity of the influence of the passing signal current through the current intensity of a control current (I);

adjusting the premagnetization of the cores (11, 12) with the current intensity passing through the control winding (17);

continuously influencing the signal current (S), independently of its form and frequency, with a quasi constant self-induction L and, thus, quasi distortion-free by the device (10) incorporated into a respective electric/electronic circuit arrangement.

13. Use according to claim 12, further comprising employing the induction winding (15) as a device of a controlled switching circuit (25); and employing the control winding (17) as a device of a controlling switching circuit (27) (FIG. 13).

14. Use according to claim 13, further comprising incorporating the device (10) in a control circuit as a controlling element.

15. Use according to claim 13, further comprising incorporating the device (10) as a measuring transformer.

16. An inductive, electrically controllable device (10) comprising one or more pairs of ferromagnetic cores (**11, 12; 11*a*, 12*a*; 11*b*, 12*b***) wherein each pair consists of two cores, which are identical in material, size, dimensions, and are magnetically independent, and each core is annularly closed as a ring structure;

wherein each core consists of a soft magnetic material, which exhibits a functional dependence of the magnetic flux density B from the magnetic field strength H (B=f(H)) which is the same for an increasing or a decreasing branch of the hysteresis whereby said material does not show any magnetic hysteresis;

wherein said material being magnetically unsaturable having no upper limit for the magnetic flux density B;

wherein said material further featuring a continually changing permeability and showing no saturation bend such that the incremental permeability (dB/dH) or the first derivative of B=f(H) or the slope of B=f(H) is varying progressively, which in turn means that for whatever value of the magnetic field strength H there is a coordinated unique value of the incremental permeability dB/dH or value of the first derivative or slope being different from each other such value, wherein said continually changing permeability is incremental, the value of which incremental permeability varies at least at a ratio maximal value/minimal value equal 100/1;

said inductive device further comprising at least one induction winding (15) wound around the cores (11,12) individually in a configuration of two partial windings (15.1, 15.2) connected in series;

at least one control winding (17) wound around the cores (11,12) jointly in such a way that a magnetic flux in the cores (10,12) created by a current circulating through said at least one induction winding (15), and the magnetic flux in the cores (11, 12) created by a control current I circulating through said at least one control winding (17), are uni-directional in one of said pair of cores (11, 12) and are inverse-directional in the other of said pair of cores (11, 12).

17. The inductive, electrically controllable device (10) according to claim 16 wherein the two cores are coaxially disposed.

18. Process for the operation of an inductive, electrically controllable device (10), comprising employing one or more pairs of identical ferromagnetic cores (11, 12; 11*a*, 12*a*; 11*b*, 12*b*) wherein each pair consists of two cores identical in material, size, dimensions, and magnetically independent, and which are each annularly closed as a ring structure;

wherein each core consists of a soft magnetic material featuring a functional dependence of the magnetic flux density B from the magnetic field strength H (B=f(H)) which is the same for an increasing and for a decreasing branch of the hysteresis and which material does not show any magnetic hysteresis;

wherein each core consists of a magnetically unsaturable material without an upper limit for the magnetic flux density B;

wherein each core consists of a material featuring a continually changing permeability and showing no saturation bend with an incremental permeability (dB/dH) or a first derivative of B=f(H) or a slope of B=f(H) varying progressively such that for whatever value of the magnetic field strength H assumes there is a coordinated unique value of the incremental permeability dB/dH or a respective value of the first derivative or slope being different from each other such value, wherein said continually changing permeability B/dH is incremental <(dB/dH)>, wherein the value of which incremental permeability varies at least at a ratio maximal value/minimal value equal 100/1; said inductive device further comprising at least one induction winding (15) wound around the cores (11,12) individually in a configuration of two partial windings (15.1, 15.2) connected in series;

at least one control winding (17) wound around the cores (11,12) jointly in such a way that a magnetic flux in the cores (10,12) created by a current circulating through said at least one induction winding (15), and the magnetic flux in the cores (11, 12) created by a control current (I) circulating through said at least one control winding (17), are uni-directional in one of said pair of cores (11, 12) and are inverse-directional in the other of said pair of cores (11, 12); comprising the steps 1st step: feeding at least one control current (I, I*a*, I*b*) through one of the control windings (17, 17*a*, 17*b*);

2nd step: setting the intensity of the current to a selected arbitrary value, including zero for premagnetizing each of the cores (11, 12);

selecting an operating point ($A_1$, $A_2$, $A_{11}$, $A_{21}$, $A_{12}$, $A_{22}$) for each of the cores;

selecting for each of the cores a desired value of the magnetic field strength H;

selecting a coordinated incremental permeability dB/dH;

3rd step: feeding at least one signal current S through one of the induction windings (15, 15*a*, 15*b*);

wherein the signal current has arbitrary form and arbitrary frequency;

4th step: setting the amplitudes of the signal current S to one intensity, that is small compared to a maximum possible intensity of the control current I such that the signal current I varies the selected magnetic frequency w with w larger than 10 kilohertz;

shaping the signal current S for an arbitrary form;

circulating the signal current S through the induction winding (15);

circulating a control current I through the control winding (17);

influencing the signal current (S) by variation of the inductivity (L) of the control current I

19. Use of a device (10) within an arbitrary electrical-/electronical circuit, the device (10) comprising one or more pairs of ferromagnetic cores (11, 12; 11*a*, 12*a*; 11*b*, 12*b*) wherein each pair consists of two cores, which are identical in material, size, dimensions, and magnetically independent, and each annularly closed as a ring structure;

wherein each core consists of a soft magnetic material, which means that there is a functional dependence of the magnetic flux density B from the magnetic field strength H B=f(H) such that for an increasing branch and for a decreasing branch of the hysteresis wherein said material is without any magnetic hysteresis;

wherein each core consists of a magnetically unsaturable material without upper limit for the magnetic flux density B;

wherein each core consists of a material featuring a continually changing permeability and showing no saturation bend such that the incremental permeability (dB/dH) or the first derivative of B=f(H) or the slope of B=f(H) is varying progressively, which in turn means that for whatever value of the magnetic field strength H having a coordinated unique value of the incremental permeability dB/dH or value of the first derivative or slope different from any other such value, wherein each core consists of a material having an incremental permeability wherein, the value of which incremental permeability varies at least at a ratio maximal value/minimal value equal 100/1;

said inductive device further comprising at least one induction winding (15) wound around the cores (11,12) individually in a configuration of two partial windings (15.1, 15.2) connected in series;

comprising at least one control winding (17) each of which is wound around the cores (11,12) jointly in such a way that a magnetic flux in the cores (10,12) created by a current circulating through at least one induction winding (15), and the magnetic flux in the cores (11, 12) created by a control current <(I)> I circulating through at least one control winding (17), are uni-directional in each one core (for example 11) of a pair of cores (11, 12); and are inverse-directional in each second core of the pair of cores (11, 12);

wherein the device (10) is appointed as a coil;

wherein the coil appointed has an inductivity L;

wherein the coil appointed influences a signal current S circulating through the coil inductively (AC resistance (reactance) of the coil: $R_{AC}=wL$ (w=frequency (sinusoidal) of the signal current S); DC resistance (ohmic resistance of the coil $R_{DC}=0$ (zero));

wherein the signal current S has an arbitrary field strength H, but this variation is small (h) ($h<<H_{max}$) such that the premagnetization (B,H) of each core is varied to B−b, H−h ($b<<B_{max}$; $h<<H_{max}$), with the main value of the premagnetization remaining unchanged.

20. A device (10) with at least one pair of first poles and at least one pair of second poles for universal use in any electrical/electronic circuit, the characteristics of which are:

(a) said device (10) operates linearly relative to an electrical voltage applied to said pair of first poles or an electrical current flowing via said pair of first poles;

(b) said device (10) has a finite inductance value L, which value is measurable between the poles of the said pair of first poles in Henry;

(c) said inductance L of the device is controllable by an electric control current I flowing via said pair of second poles;

(d) the ratio of the minimum value of said inductance and the maximum value of said inductance is settable by said electrical control current I to at least one to one hundred.

* * * * *